United States Patent [19]

Suzuki et al.

[11] Patent Number: 4,468,112

[45] Date of Patent: Aug. 28, 1984

[54] DEVELOPER CONCENTRATION CONTROLLING DEVICE

[75] Inventors: Akio Suzuki, Tokyo; Kazuhiro Hirayama, Yokohama, both of Japan

[73] Assignee: Canon Kabushiki Kaisha, Tokyo, Japan

[21] Appl. No.: 347,789

[22] Filed: Feb. 11, 1982

[30] Foreign Application Priority Data

Feb. 18, 1981 [JP] Japan ..... 56-21345
Feb. 18, 1981 [JP] Japan ..... 56-21346
Feb. 18, 1981 [JP] Japan ..... 56-21347

[51] Int. Cl.[3] ..... G03G 15/00

[52] U.S. Cl. ..... 355/14 D; 355/3 DD; 118/689

[58] Field of Search ..... 355/14 D, 3 DD; 118/688, 689, 690, 691

[56] References Cited

U.S. PATENT DOCUMENTS

| | | | |
|---|---|---|---|
| 3,572,551 | 3/1971 | Gillespie et al. | 118/689 X |
| 3,932,034 | 1/1976 | Takahashi | 118/689 X |
| 3,970,036 | 7/1976 | Baer et al. | 118/688 |
| 4,026,643 | 5/1977 | Bergman | 355/14 D |
| 4,082,445 | 4/1978 | Steiner | 355/14 D |
| 4,195,260 | 3/1980 | Sakamoto et al. | 355/3 DD |
| 4,200,665 | 4/1980 | Suzuki et al. | 355/14 D |
| 4,210,864 | 7/1980 | Miyakawa et al. | 355/3 DD |
| 4,226,525 | 10/1980 | Sakamoto et al. | 118/689 X |
| 4,248,527 | 2/1981 | Akiyama et al. | 355/14 D |
| 4,270,487 | 6/1981 | Terashima et al. | 355/3 DD |
| 4,277,162 | 7/1981 | Kasahara et al. | 355/14 D |
| 4,277,549 | 7/1981 | Tatsumi et al. | 355/14 D |
| 4,313,671 | 2/1982 | Kuru | 355/14 D |
| 4,341,461 | 7/1982 | Fantozzi | 355/14 D |
| 4,343,548 | 8/1982 | Bares et al. | 355/14 D |
| 4,347,299 | 8/1982 | Ozawa et al. | 355/14 D |
| 4,348,100 | 9/1982 | Snelling | 355/14 D X |
| 4,365,894 | 12/1982 | Nakamura | 355/14 D |

*Primary Examiner*—R. L. Moses

*Attorney, Agent, or Firm*—Fitzpatrick, Cella, Harper & Scinto

[57] ABSTRACT

A device for controlling the developer concentration in an electrophotographic copier or the like, in which a first detector for detecting the developer concentration and a second detector for detecting the image density are utilized for controlling process devices to maintain a constant optimum image density.

17 Claims, 23 Drawing Figures

DEVELOPER CONCENTRATION CONTROLLING DEVICE

BACKGROUND OF THE INVENTION

1. Field of the Invention

The present invention relates to a device for controlling the concentration of the developer employed in recording apparatus such as a copier or a laser beam printer, thereby maintaining a constant optimum image density in such recording apparatus.

2. Description of the Prior Art

Developer composed of a mixture of toner particles and carrier particles is employed in certain recording apparatus such as dry-process electrophotographic copier and electrostatic recording apparatus. As an example of such recording apparatus, FIG. 1 schematically shows the structure of a conventionally known laser beam printer, in which a laser beam 17 generated by a laser device 15 is modulated by an A/0 modulator 16 in response to video signals 13 corresponding to the information for printing stored in a page memory 11. The laser beam 17 thus modulated is reflected by a polygonal mirror 25 rotated in a direction a for effecting principal scanning, then focused by an f-$\theta$ lens 27 and guided by a deflecting mirror 29 to a photosensitive member 33 essentially composed of a conductive substrate, a CdS photoconductive layer and an insulating laryer and provided on a photosensitive drum 31.

Said photosensitive member 33 of the drum 31 rotated in a direction b for auxiliary scanning is at first uniformly charged to a potential of several thousand volts by a corona discharge from a primary charger 41, then is exposed to the laser beam 17 modulated by the A/0 modulator 16 according to the video signals 13 simultaneously with the charge elimination with a charge eliminater 42 by an AC corona discharge or a DC corona discharge of a polarity opposite to that of the primary charging, and is uniformly illuminated by an exposure lamp 44 to form an electrostatic latent image of an elevated contrast on said photosensitive drum 31. The photosensitive member 33 bearing said electrostatic latent image shows locally varied electrostatic potential.

The electrostatic latent image formed on the photosensitive member 33 is developed into a visible image in a developing device 43 by depositing toner from developer 45 charged to a potential of several hundred volts. The toner image thus developed is transferred by a transfer charger 47 onto a transfer sheet 49 transported in a direction c, thus reproducing the information stored in the page memory 11 on said transfer sheet 49.

After the image transfer, a cleaning blade 51 removes the remaining toner and unrepresented means dissipates the remaining potential to prepare the photosensitive member for the succeeding image formation.

The developer 45 contained in the developing device 43 is generally a two-component developer composed of a mixture of toner particles and carrier particles, and the weight mixing ratio thereof has a significant influence on the image development to be achieved by the developing device 43.

For example, an excessively low toner concentration in the developer 45 will provide a low image density, while an excessively high toner concentration will give an excessively high image density combined with a background fog, eventually forming an unacceptable image on the transfer sheet 49.

Consequently, in order to constantly obtain an image of a desirable density, it is essential to maintain the toner concentration in the developer 45 at an appropriate and constant level during the image development.

There have been proposed various methods for maintaining a constant toner concentration.

One of such methods is to control the amount of toner replenishment in response to the optical detection of the image density after the development. Although this method allows control of the amount of toner replenishment in direct relation to the image density, it is inevitably associated with unstable density control because of the error in the detection caused for example by a smear on the optical sensor.

Other methods control the amount of toner replenishment through the detection of a change in the magnetic permeability or dielectric constant of the developer or through the detection of a change in the color of the developer composed of carrier and toner of different colors. Such methods are however unable to maintain the toner concentration at an appropriate level over a prolonged period, as they are apt to be influenced by the spent toner particles which are present in the developer but do not contribute to the developing process. Also such methods, not based on the direct measurement of the developed image density, are unable to compensate the image density by regulating the toner concentration in case the electrostatic potential on the photosensitive member shows a change after prolonged use to a level giving inappropriate image density.

Also there are known improved methods of detecting the change in the volume of developer 45 and effecting control to maintain said volume at a constant level, as disclosed in Japanese Laid-Open Pat. No. Sho 50-19459 entitled "Method for detecting and controlling the concentration of electrophotographic developer" and in Japanese Laid-Open Pat. No. Sho 51-78343 entitled "Electrophotographic developing device". Again referring to FIG. 1, these methods are based on the fact that the consumption of the developer 45 in the developing device 43 is mostly due to consumption of the toner and that the consumption of the carrier is zero or very small. Thus, assuming that the decrease in the volume of the developer 45 is caused solely by the consumption of toner or by the consumption of developer in which the consumption of toner is at a fixed level determined by the consumption of the carrier, these methods measure the decrease in the volume of the developer 45 and feed a replenishing developer in which the toner concentration is 100% or said fixed level to maintain the developer 45 at a constant volume in the developing device 43, thereby maintaining a constant toner concentration in the developer 45.

In practice, however, the ratio of the consumption of toner and carrier is not constant but is dependent on the area of recording. Consequently the replenishing developer of a fixed toner concentration causes a change in the toner concentration in the developer 45 after a prolonged period. In order to resolve such drawback, there has been proposed a method of optically detecting the image density after development and replenishing the carrier when the image density becomes excessively high due to the consumption of the carrier. In such method, however, the image density will become excessively low if the carrier is excessively replenished by error, and it will become necessary in such case to immediately regulate the toner concentration in the developer 45 by an additional replenishment of the toner. However, in case the toner replenishment is controlled by the detection of decrease in the developer volume as explained above, the toner replenishment may not be conducted in such state since the volume of tne developer 45 is already increased by the replenishment of the carrier. Consequently, in such state it becomes necessary to continue to use the recording apparatus with the thus lowered image density for a considerable period, as the removal of carrier along from the developer is generally quite difficult.

SUMMARY OF THE INVENTION

The object of the present invention is to provide a developer concentration controlling device capable of maintaining a stable and appropriate development in a recording apparatus for a prolonged period.

Another object of the present invention is to provide a recording apparatus capable of detecting the developer concentration and the image density, and of controlling at least one of plural process means in response to the result of said detection.

Still another object of the present invention is to provide a developer concentration controlling device capable of adjusting the detection level for the developer concentration in response to the image density after development.

Still another object of the present invention is to provide a developer concentration controlling device capable of detecting the decrease of carrier in the developer and replenishing said carrier.

Still another object of the present invention is to provide a developer concentration controlling device capable of regulating the developer concentration to a reference value when said developer concentration becomes outside an acceptable range.

The foregoing and still other objects of the present invention will be made fully apparent from the following description.

DETAILED DESCRIPTION OF THE PREFERRED EMBODIMENTS

Now the present invention will be clarified in detail by the following description to be taken in conjunction with the attached drawings.

Figure 1:
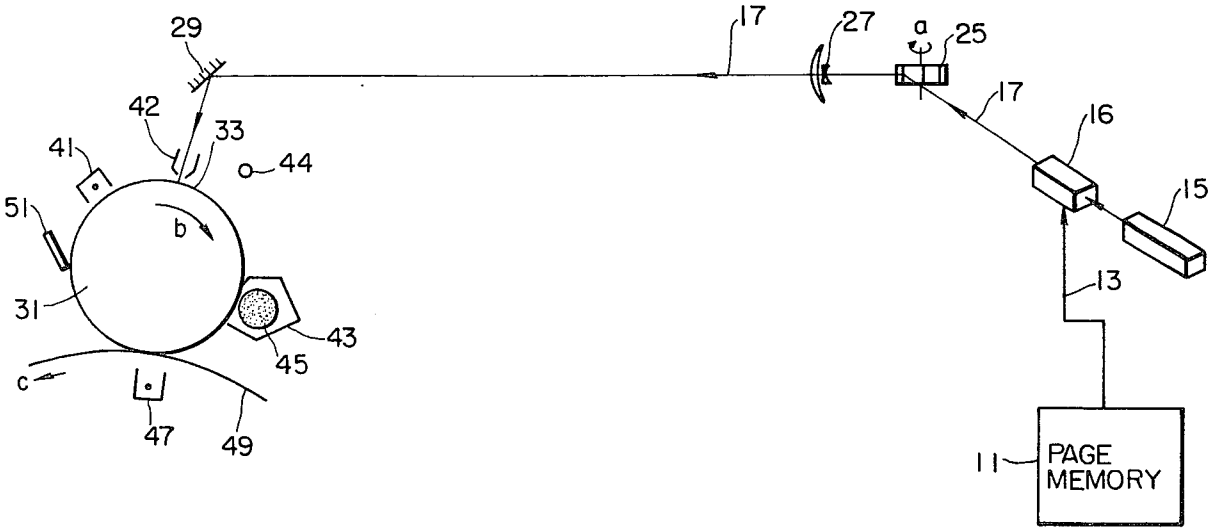
FIG. 1 is a schematic view showing the structure of a conventional laser beam printer.
Figure 2:
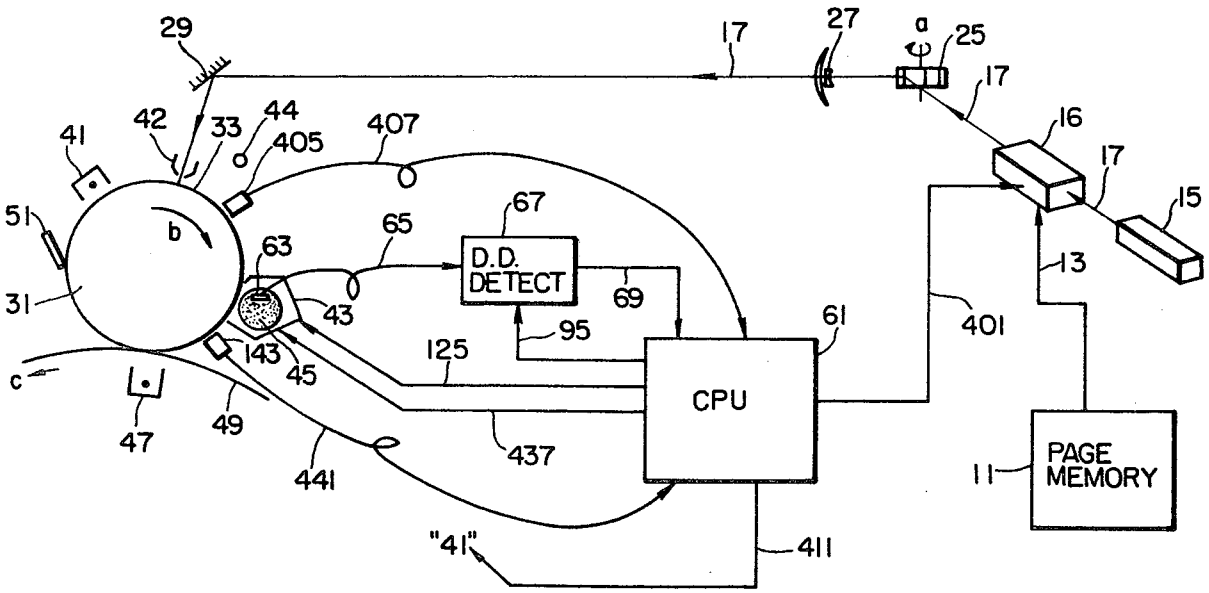
FIG. 2 is a schematic view showing the structure of a laser beam printer embodying the present invention.

FIG. 2 shows the structure of a laser beam printer embodying the present invention, which is different from that shown in FIG. 1 in having a central processing unit 61 (to be hereinafter called a CPU) and a related control unit, with components the same as those in FIG. 1 being represented by the same numbers.

In FIG. 2, in order to identify the toner concentration of the developer 45 in the developing device 43, a developer concentration detector unit 67 supplies a concentration detection signal 69 to the CPU 61 in response to a detection signal from a magnetic permeability sensor 63.

Figure 3:
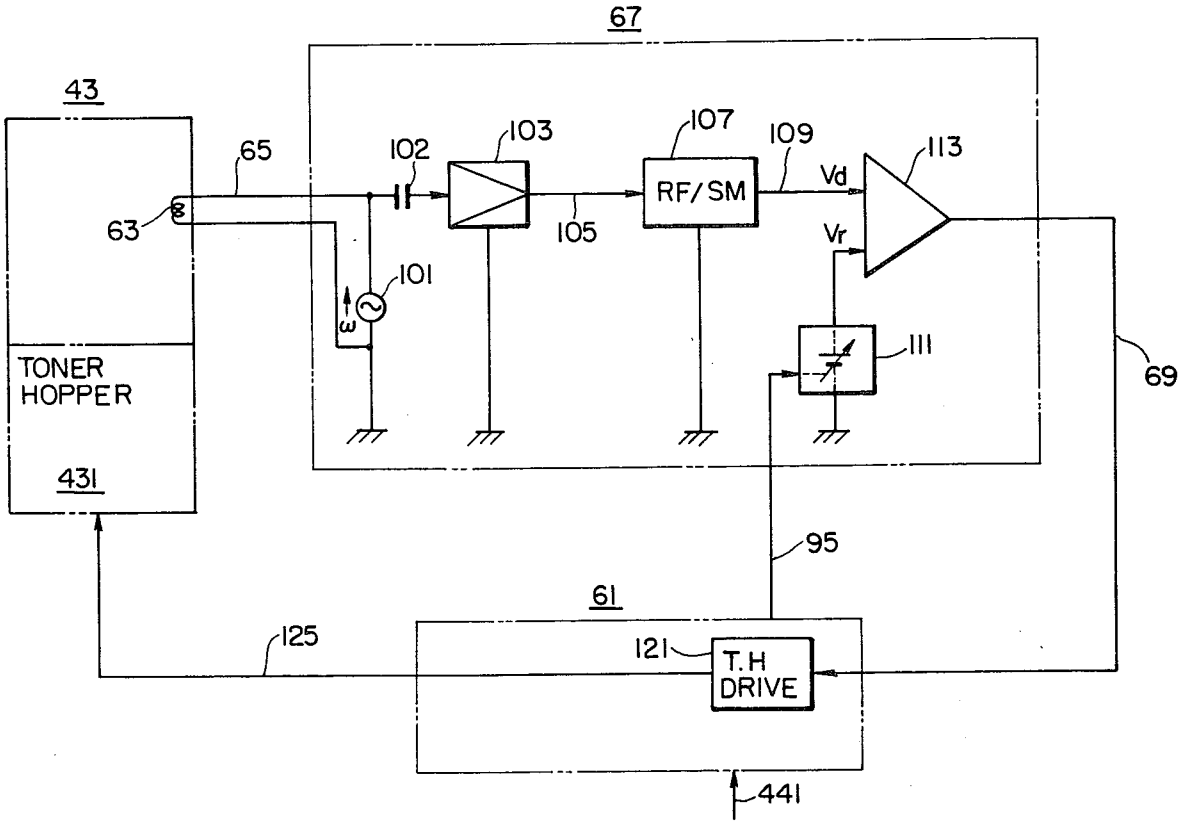
FIG. 3 is a block diagram showing a developer concentration detector unit.

FIG. 3 shows the structure of said developer concentration detector unit 67, wherein the magnetic permeability sensor 63 is formed as a flat plate of a determined area maintained in constant contact with the developer 45 in the developing device 43 and changes the equivalent conductance corresponding to the change in the magnetic permeability of the developer 45. An AC power source 101 supplies an AC voltage of a determined angular frequency $\omega$ to said sensor 63, and also to an AC amplifier 103 through a condenser 102. The output signal 105 from said amplifier 103 is supplied to a rectifying-smoothing circuit 107 for example composed of a diode and a condenser to obtain a signal 109 of a DC voltage Vd, which is supplied, together with a reference voltage Vr from a variable voltage source 111, to a comparator 113 to obtain the aforementioned concentration detection signal 69 therefrom.

Figure 4:
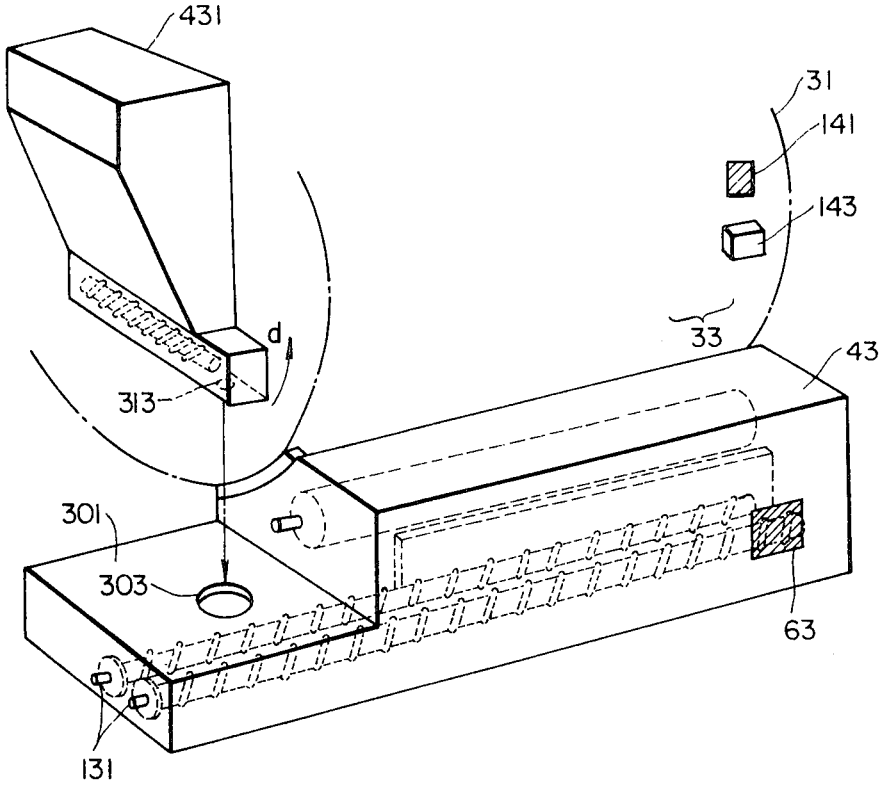
FIG. 4 is a perspective view showing the details of a part of the apparatus shown in FIG. 2.
Figure 5:
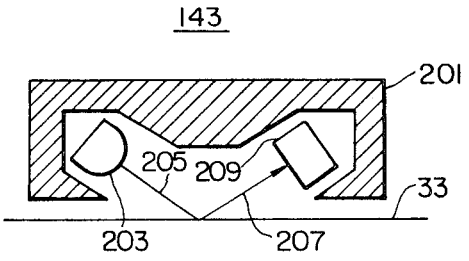
FIG. 5 is a schematic view showing the structure of a reflective density detector unit.

FIG. 4 shows the details of a part of the structure shown in FIG. 2, wherein a reflective density detector unit 143 is positioned close to the photosensitive member 33 in order to measure the optical density of an image developed from an electrostatic latent image formed, as will be explained later, in a reference image area 141 on said photosensitive member 33. As shown in FIG. 5, in said reflective density detector unit 143, a light-emitting diode 203 positioned in a casing 201 emits a light beam 205 toward the photosensitive member 33, and the reflected light 207 is received by a photodiode 209.

An outer casing 301 of the developing device 43 is provided with an aperture 303, and a toner hopper 431 is mounted on the developing device 43 in such a manner that a toner supply aperture 313 of said hopper 431 coincides with said aperture 303.

Now the function of the above-explained apparatus will be explained in the following in relation to FIGS. 2 to 4. In case the toner concentration in the developer 45 is lowered, thus elevating the proportion of the magnetic carrier, the sensor 63 increases the equivalent conductance L corresponding to the toner concentration, whereby the output signal from the amplifier 113 based on the signal of a determined frequency from the AC power source 101 changes, causing a significant change in the DC voltage Vd supplied to the comparator 113. When said voltage Vd exceeds the reference voltage Vr, the detection signal 69 supplied from said comparator 113 energizes a toner hopper drive unit 121 in the CPU 61, thereby activating the toner hopper 431 through a drive signal 125 to replenish the developing device 43 with a replenishing developer composed solely of toner or containing carrier with a determined proportion through the aforementioned aperture 313. Upon continued toner replenishment, the toner concentration in the developer 45 is gradually elevated whereby the DC voltage Vd approaches the reference voltage Vr. When the DC voltage Vd becomes equal to the reference voltage Vr, the toner hopper drive unit 121 is deactivated to terminate the toner replenishment, whereby the toner concentration in the developer 45 is maintained at a constant level determined by the setting of the variable voltage source 111.

However the structure explained in the foregoing merely detects the toner concentration including the aforementioned spent toner not contributing to the image development, and is therefore unable to distinguish a state of adequate image density from a state of suspended toner replenishment due to erroneously identified image density. Also no compensation is provided for the time-dependent change of the photosensitive member.

Consequently, according to the present invention, the detection level of the toner concentration explained above is changed in response to the output of detector means for optically measuring the image density.

Figure 6:
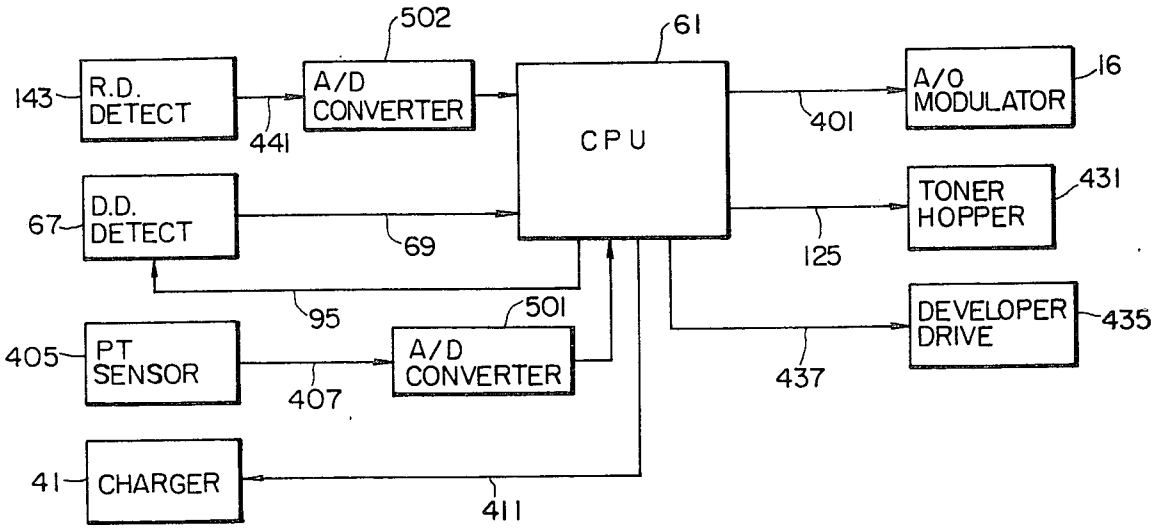
FIG. 6 is a block diagram of a control unit in the apparatus shown in FIG. 2.

FIG. 6 shows the CPU 61, which can be composed for example of a microprocessor 8080 supplied by Intel Corp., and related control units. There will now be explained the control sequence shown in FIG. 7, while making reference to FIGS. 2 to 6.

In the following it is assumed that the concentration controlling operation is conducted during the pre-rotation of the photosensitive drum 31 immediately prior to the recording operation. In said concentration controlling mode, the A/0 modulator 16 is so controlled by a control signal 401 from the CPU 61 that the laser beam 17 is not directed toward the mirror 25, whereby the photosensitive member 33 is not subjected to charge elimination by the laser beam 17, thus obtaining an electrostatic potential $E_1$, which is detected by the potential sensor 405 positioned close to the photosensitive member 33. The detection signal 407 thus obtained is supplied, after digitizing in an A/D converter 501, to the CPU 61 for storing said potential $E_1$. Subsequently the CPU 61 controls the A/0 modulator 16 in such a manner as to direct the laser beam 17 toward the photosensitive member 33 through the mirror 25, whereby the photosensitive member 33 is subjected to charge elimination by the laser beam 17, thus obtaining an electrostatic potential $E_2$ which is likewise detected by the potential sensor 405 (Step 701). Then the CPU 61 releases a charging control signal 411 to regulate the charging voltage of the primary charge 41 in such a manner that said potentials $E_1$ and $E_2$ remain at determined constant levels (Steps 703 and 705). It is to be noted that such control of the charging voltage can also be conducted in the secondary charger 42 or in the primary and secondary chargers 41 and 42.

Subsequently the CPU 16 controls the A/0 modulator 61 to direct the laser beam toward the mirror 25, and the principal scanning (direction a) and the auxiliary scanning (direction b) are suitably effected with the laser beam 17 in this state to form an electrostatic latent image in the reference image area 141. Then a developer drive unit 435 for the developing device 43 is activated by a signal 437 to develop said latent image in the reference image area 141. The density of the thus developed image is measured by the reflective density detector unit 143, and the obtained detection signal 441 is digitized by an A/D converter 502 to store the reference image density $D_p$ in the CPU 61. Then the A/0 modulator 16 is suitably controlled and the background density $D_o$ on the photosensitive member 33 after the image development is similarly measured (Step 707). Then it is identified if said densities $D_p$ and $D_o$ are at abnormal state outside the determined range (Step 709). If such abnormal levels are found, an abnormality signal is generated for display for example through a lamp and the detection level is shifted to the standard value (Step 711), and the program proceeds to the ordinary printing mode (Step 713).

Also when said densities are identified as normal in the Step 709, it is further identified if said densities $D_p$ and $D_o$ satisfy a desired relationship, for example a predetermined density ratio or density defference (Step 721). If the result of said identification is affirmative indicating an appropriate developer concentration, the program proceeds to the printing mode (Step 731). On the other hand, if said result is negative, it is further identified if the reflective density is excessively high (image being too dark) or excessively low (image being too light) (Step 723), and the detection level Vr of the developer concentration detector unit 67 is respectively lowered (Step 725) or elevated (Step 727). Now there will be explained the means for controlling said detection level Vr.

In response to the image densities $D_p$ and $D_o$ stored in the CPU 61 corresponding to the detection signal 441 from the reflective density detector unit 143, the CPU 61 releases a control signal 95 to control the reference voltage Vr from the variable voltage source 111 according to a known process. For instance said signal 95 is composed of a coded digital signal which is converted into an analog reference voltage Vr. As an alternative method said variable voltage source 111 can be composed of plural constant voltage sources from which a desired voltage is selected. It is furthermore possible to obtain the detection signal 69 by selecting one of plural comparators having mutually different reference voltages.

During the printing mode in the Step 713, the replenishment of the replenishing developer from the toner hopper 431 is conducted according to the thus newly determined detection level Vr.

The aforementioned influence of the spent toner is thus avoided since the toner concentration in the developer is controlled to obtain an optimum image density in direct response to the measured density of the developed image.

The reflective density detector unit 143 is however apt to be smeared for example by toner, and the normal detecting function is hindered particularly when the light-receiving face of the photodiode 209 is smeared.

Also a functional failure may occur in the detector unit 143 itself. Such failure may lead to a significant change in the toner concentration due to an abnormal setting of the detection level Vr for the magnetic permeability. In order to avoid such undesirable situation, in the present embodiment, the Step 711 shifts said detection level to a standard value in response to the detection of an abnormal image density, whereby the toner concentration control is effected with said standard detection level to allow continued use of the recording apparatus without interruption although the image density to be obtained is not optimum until the detector unit 143 is repaired.

The above-explained operation of the concentration controlling mode can also be effected once every day immediately prior to the first recording operation after the start of power supply, or every time prior to the re-start of the recording operation after it is interrupted, or at a regular interval through the use of a timer.

It is furthermore possible to select one of plural detection levels for detecting the developer volume in the developing device in response to the optically measured density of a reference image formed on the photosensitive member, and to control the developer replenishment according to the thus selected detection level. Such procedure is employed in another embodiment to be explained in the following.

Figure 8A:
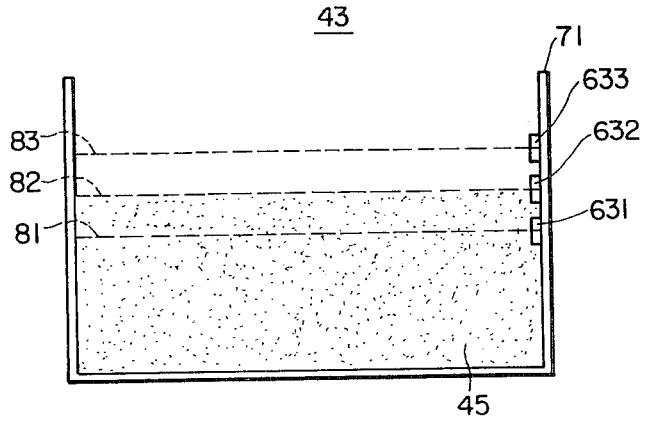
FIGS. 8A and 8B are schematic views showing the structure of a developing device.
Figure 8B:
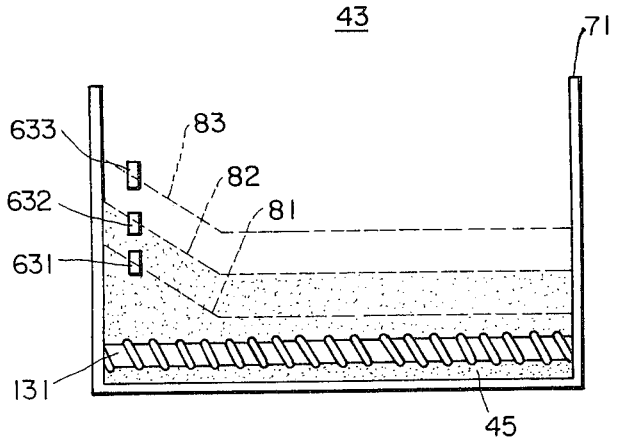

FIGS. 8A and 8B show different examples of the developing device 43, wherein a container 71 is equipped with three sensors 631, 632 and 633 constituting the developer volume sensor 63. The laser beam printer in this case is structured essentially the same as that shown in FIG. 2. It is assumed that the reference detection level is selected at a level 82 corresponding to the detector 632. A decrease of the developer volume below the reference level 82, caused by the consumption of the toner, can therefore be detected by said detector 632, and the corresponding detection signal 69 activates the toner hopper through the CPU 61 to replenish the developing device 43 with a replenishing developer having a determined ratio of toner and carrier, whereby the developer volume in the developing device 43 is restored to said level 82. A similar function is attained also when the reference detection level is selected at another level 81 or 83 corresponding to another detector, and a constant developer volume can be maintained with respect to either detection level to achieve a constant developer concentration. Such process is in practice capable of maintaining a constant toner concentration in the developer for a relatively short period corresponding to 100 to 200 thousand copies of A4 size.

Figure 9:
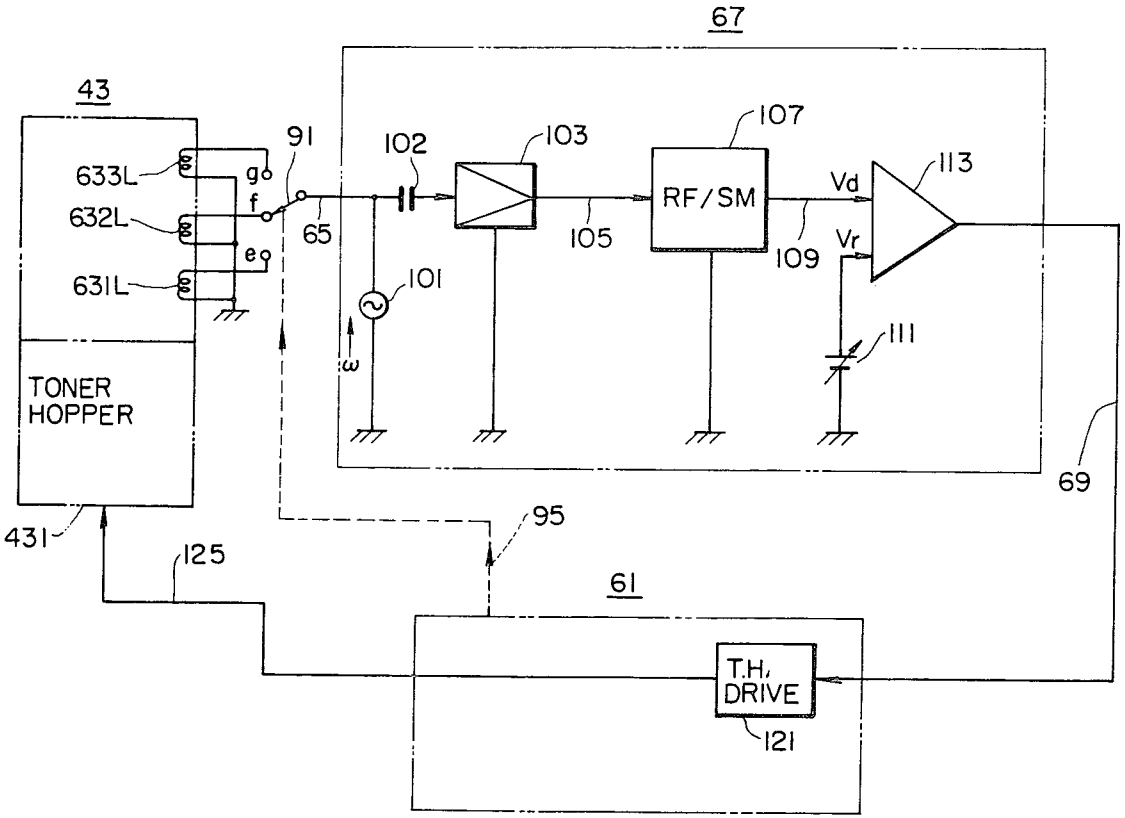
FIG. 9 is a block diagram of a developer volume detector unit for the developing device shown in FIG. 8.

FIG. 9 shows the developer volume detector unit 67, wherein three detectors 631, 632 and 633 in the developing device 43 have equivalent inductances 631L, 632L and 633L which vary according to the magnetic property of the carrier contained in the developer 45. More specifically said inductance 631L, 632L or 633L increases when the developer 45 is respectively present at the level 81, 82 or 83. A switch 91 is provided to select one of said detectors 631, 632 and 633. It is now assumed that the switch 91 is connected to a contact f for selecting the detector 632 in response to a selecting signal 95 from the CPU 61. The AC power source 101 supplies an AC voltage of a determined angular frequency $\omega$ to said detector 632, and also to the amplifier 103 through the condenser 102. The amplified output signal 105 from said amplifier 103 is supplied to the rectifying-smoothing circuit 107 composed for example of a diode and a condenser to obtain a signal 109 of a DC voltage Vd, which is supplied, together with a reference voltage Vr from the variable voltage source 111, to the comparator 113.

A resonance circuit is formed by said detector 632 and the condenser 102. In the presence of the developer 45 at the level 82, the detector shows an increased inductance 632L causing a resonance with the angular frequency $\omega$ of the AC power source 101. On the other hand, such resonance does not take place if the developer 45 is positioned below the detection level 82.

In case the switch 91 is connected to the contact e or g, a similar resonance takes place only when the developer volume reaches the level 81 or 83 respectively.

Such resonance significantly changes the DC voltage, Vd, so that the presence of developer at the level 81, 82 or 83 can be detected through comparison with a suitably selected reference voltage Vr. The volume detection signal 69 obtained from the comparator 113 is supplied to the toner hopper drive circuit 121 in the CPU 61 to generate a drive signal 125 for the toner hopper. In this manner the toner concentration control previously explained in relation to FIGS. 8A and 8B can be achieved with a sensitivity improved by said resonance, through the selection of the detection level 81, 82 or 83 corresponding to the detector 631, 632 or 633.

FIG. 8B shows another embodiment of the developing device 43, which is different from the embodiment of FIG. 8A in that a screw 131 is rotated at the detection of the developer volume in order to accumulate the developer 45 against an inner wall of the container 71 where the detectors 631, 632 and 633 are positioned, thereby enabling more accurate detection of the developer volume.

Figure 10:
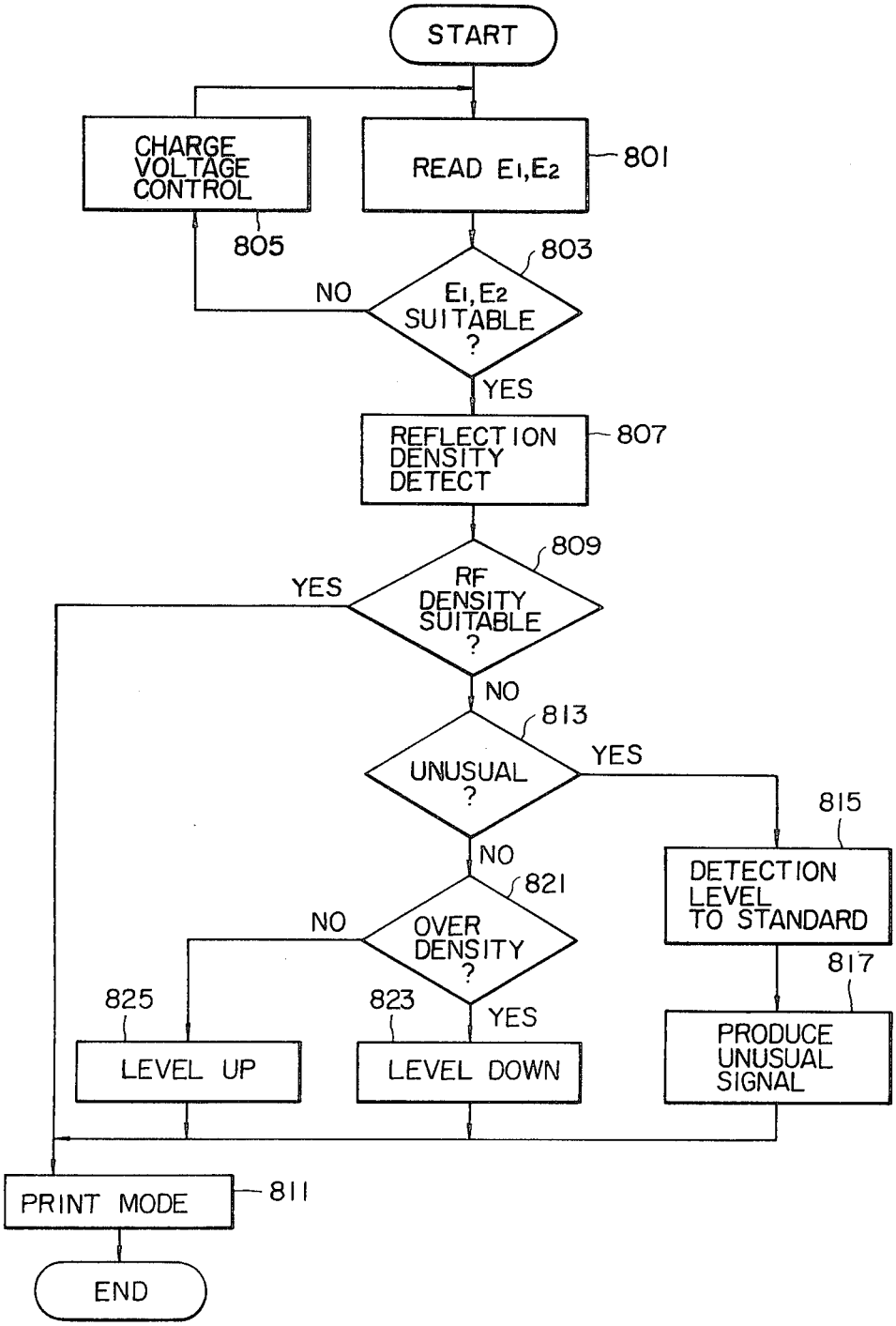
FIG. 10 is a flow chart showing the function of another embodiment of the present invention.

FIG. 10 shows the control sequence in this embodiment, wherein the density measurement of the reference image is conducted in the same manner as in the foregoing embodiment shown in FIGS. 4 and 5, and the control unit is structured in the same manner as shown in FIG. 6. Now the control sequence will be explained in the following while making reference to FIGS. 2, 4 to 6 and 8 to 10.

Figure 7:
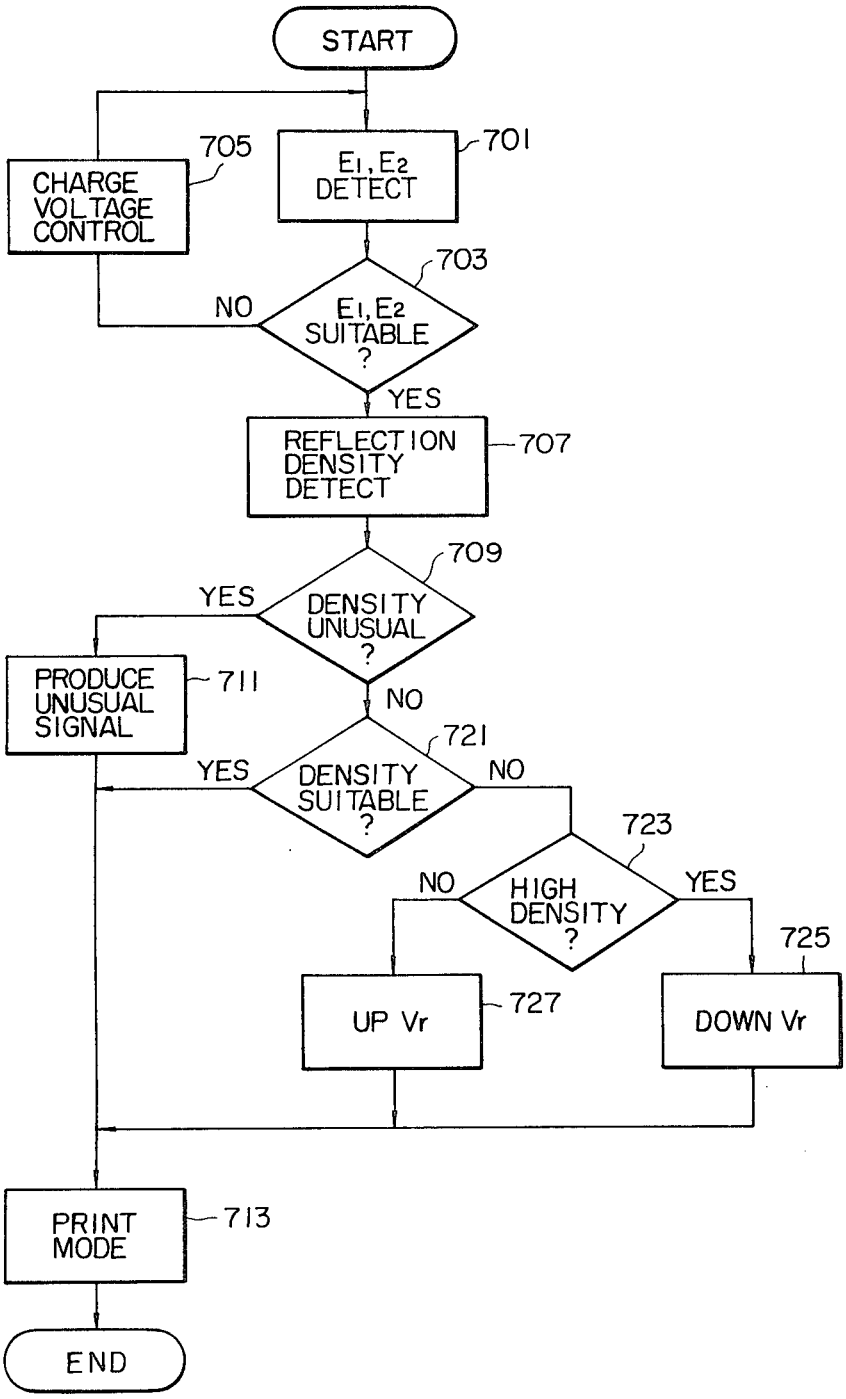
FIG. 7 is a flow chart showing the function of an embodiment of the present invention.

The Steps 801 to 807 are similar to the Steps 701 to 707 shown in FIG. 7 and are therefore omitted from the following explanation.

A Step 809 identifies if the densities $D_p$ and $D_o$ satisfy a determined relationship, for example a determined density ratio or density difference. If the result of said identification is affirmative indicating an appropriate developer concentration, the program proceeds to the printing mode (Step 811).

On the other hand, if said result is negative indicating an inappropriate image density, the developer concentration is corrected in the following procedure, in which provided are three detection levels for the developer volume as already explained in relation to FIGS. 8A and 8B.

In this state the CPU 61 is capable of identifying whether the reference detection level is located at the level 81, 82 or 83, from the logic state of the selecting signal 95 for the switch 91.

Subsequent to the above-mentioned Step 809, a Step 813 identifies if the density of the developed image is abnormal. If it is identified as abnormal, the detection level is shifted to a standard level, for example the level 82 (Step 815), then an abnormality signal is produced for example for display through a lamp (Step 817), and the program proceeds to the printing mode (Step 811).

If the result of identification in the Step 813 is negative, it is identified whether the reflective density is excessively high (Step 821), and, if so, the CPU 61 shifts the switch 91 to select the lower detection level (Step 823). The program then proceeds to the printing mode (Step 811). The recording apparatus in such state provides an appropriate image density since the replenishing developer is not supplied until the developer volume reaches the thus lowered detection level.

Also in case the identification in the Step 821 indicates an excessively low density, the detection level is elevated (Step 825) and the program proceeds to the printing mode (Step 811). In such state the replenishing developer is supplied from the toner hopper 431 until the developer volume reaches the thus elevated detection level, whereby the toner concentration in the developer is elevated to an appropriate level capable of providing an appropriate image density.

During the printing operation in the Step 811, the developer volume in the developing device 43 is constantly measured according to a principle already disclosed in the aforementioned Japanese Laid-Open Pat. Nos. Sho 50-19459 and Sho 51-78343, and, upon detection of a decrease in the developer volume by the detector unit 67, the motor of the toner hopper 431 is energized, only when said developing device 43 is activated, to replenish the developing device 43 with a replenishing developer composed solely of toner or having a determined carrier ratio through the aperture 313 until said detector unit 67 no longer detects said decrease of developer.

As already explained in relation to the foregoing embodiment, such concentration controlling operation can be conducted either once every day immediately prior to the first printing operation after the start of power supply, or every time prior to the re-start of the printing operation after it is interrupted for a while, or at a regular interval through the use of a timer.

As already explained in relation to FIG. 10, the CPU 61 selects a standard detection level (Step 815) in response to an abnormality signal produced in the Step 817. More specifically, in response to a selection signal 95 from the CPU 61, the switch 91 is connected to the contact, f for selecting the detector 632, thus selecting the detection level 82, so that the toner concentration control is continued during the printing mode (Step 811) under such standard detection level. Such procedure not only avoids the danger of significant change in the toner concentration in the developer eventually resulting from an erroneous detection in the detector unit 143 caused for example by a smear on the photodiode 209 in the detector unit 143, but also allows the continued use of the recording apparatus under said toner concentration control with such standard detection level, thereby eliminating the necessity for the immediate repair of the detector unit 143.

Although the volume sensor 63 in the foregoing embodiment is composed of three elements 631, 632 and 633 selectable by a switch, it is also possible to constitute said sensor by a single sensing element.

Figure 11:
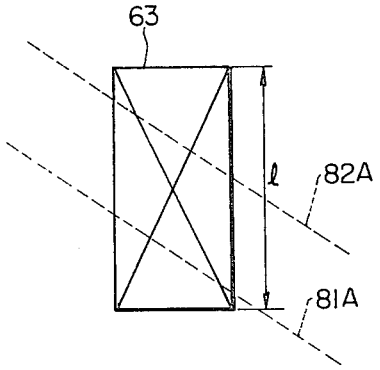
FIGS. 11, 12A, 12B and 13 are schematic views showing other embodiments of the developer volume sensor.

FIG. 11 shows an embodiment of such single-element sensor 63, which has a certain length and is positioned on an inner wall of the container 73 in such a manner that the longitudinal direction thereof crosses the volume levels of the developer 45. Said sensor 63 shows a variable equivalent inductance according to the sensor area covered by the developer 45, and provides different inductances for example when the developer volume reaches a level 81A and another level 82A, thus accordingly regulating the DC voltage Vd from the detector unit 67 shown in FIG. 4. Consequently a similar detecting operation is rendered possible by variably selecting the reference voltage Vr from the variable voltage source 111 according to the required detection level. It is furthermore possible, in such case, to select one of plural reference voltage sources or to select one of plural comparators having mutually different reference voltages.

Figure 12A:
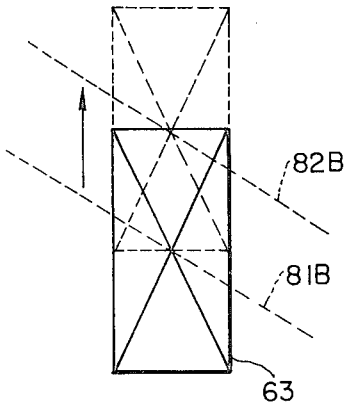
Figure 12B:
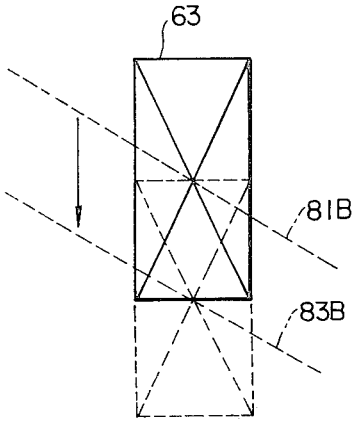

FIGS. 12A and 12B show another embodiment in which the detection level is rendered variable by the displacement of the sensor 63. The detection level, positioned at the center of the sensor 63, is shifted from a level 81B to 82B by a upward displacement of the sensor 63 as shown in FIG. 12A, or shifted to 83B by a downward displacement of the sensor 63 as shown in FIG. 12B. In this manner there can be provided three different detection levels in this case.

Figure 13:
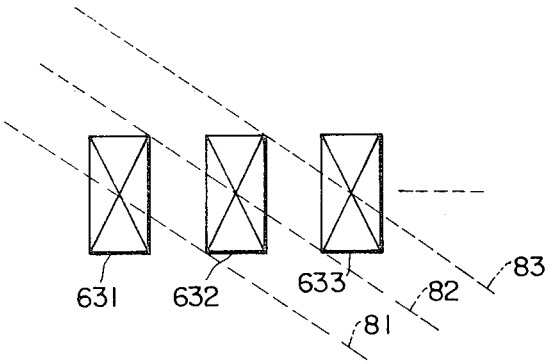

FIG. 13 shows still another embodiment in which the sensor 63 is composed of plural elements arranged horizontally instead of the vertical arrangement shown in FIGS. 8A and 8B. In this embodiment, the sensor elements 631, 632 and 633 respectively representing the detection levels 81, 82 and 83 are selected by a switch as shown in FIG. 9. In the present embodiment the volume detection is achieved by accumulating the developer by the screw 131 as shown in FIG. 8B.

The number of detection levels for the developer volume explained in relation to FIGS. 8A and 8B is not necessarily limited to two or three but can be further increased if necessary or desirable. For example there may be employed more than three sensor elements constituting the sensor 63, for selection by the CPU 61. If the image density is excessively low, the CPU 61 stepwise elevates the detection level until it exceeds the present developer volume, and effects the toner replenishment up to said detection level. On the other hand, if the image density is excessively high, the detection level is lowered by a step and the toner replenishment is suspended until the developer volume reaches said detection level. The detection level is further lowered if the image density is still excessively high.

It is furthermore possible to select one of plural detection levels for detecting the developer volume in the developing device in response to the optically measured density of a developed reference image formed on the photosensitive member or an image recorded therefrom, and to control the developer concentration by the replenishment of toner or carrier to the developer.

Figure 14:
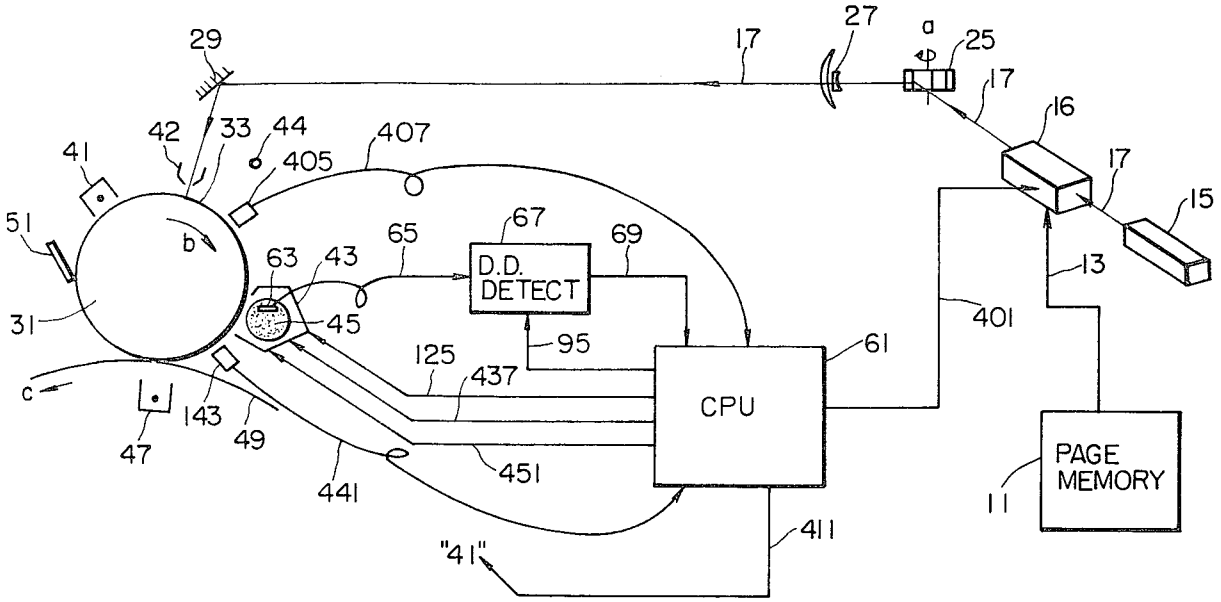
FIG. 14 is a schematic view showing the structure of another embodiment of the laser beam printer according to the present invention.

Such process is employed in another embodiment of the laser beam printer shown in FIG. 14, in which the same components as those in FIG. 2 are represented by same numbers.

In FIG. 14, in response to the detection signal 65 from the developer volume sensor 63 representing the developer volume in the developing device 43, the developer volume detector unit 67 supplies the volume detection signal 69 to the CPU 61, which thus releases a drive signal 437 for the developing device and a carrier control signal 451 as will be explained later.

Figure 15A:
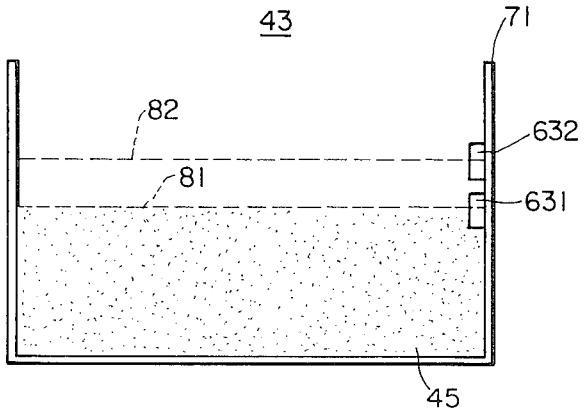
FIGS. 15A and 15B are schematic views showing another embodiment of the developing device.
Figure 15B:
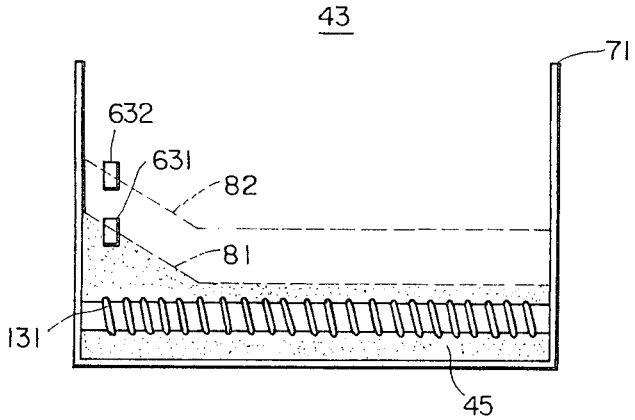

FIGS. 15A and 15B show two different examples of the developing device 43, wherein the container 71 is internally provided with two sensor elements 631 and 632 constituting the developer volume sensor 63. It is assumed that the volume detection is effected at the lower detection level 81 corresponding to the sensor element 631. When the developer volume becomes lower than the level 81 by the consumption of the toner in the developer 45, the sensor element 631 releases the detection signal 69, in response to which the CPU 61 activates the toner hopper to be explained later to replenish the developing device with a replenishing developer composed solely of toner or containing carrier in a determined proportion, thereby restoring the developer volume in the developing device 43 to the level 81. A similar function is effected also when the higher detection level 82 corresponding to the other sensor element 632 is selected for the developer volume detection. In this manner it is possible to maintain a constant toner concentration in the developer by controlling the developer volume to the constant detection level, as already explained, for a relatively short period corresponding to 100–200 thousand copies of A4 size. In practice, however, the consumption in the developer 45 is not limited to the toner but also takes place for the carrier.

As the ratio of consumption of toner and carrier varies depending on the recording area, the toner concentration in the developer 45 fluctuates during a prolonged period if a replenishing developer composed solely of toner or containing a determined proportion of carrier is employed. However the toner concentration in the developer always increases if the amount of carrier in said replenishing developer is less than the amount of carrier consumption in the developer 45.

Figure 16:
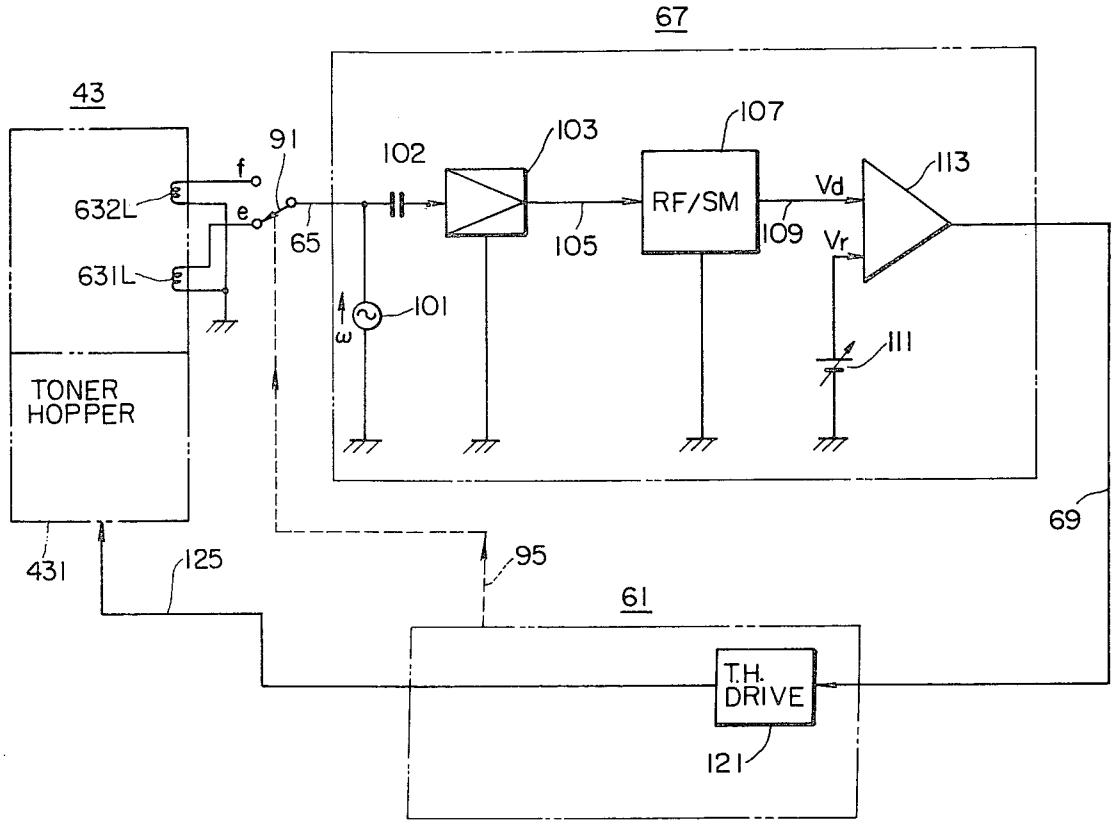
FIG. 16 is a block diagram of another embodiment of the developer volume detector unit for the developing device shown in FIG. 15.

FIG. 16 shows the developer volume detector unit 67 employed in the present embodiment, wherein the sensor elements 631, 632 positioned in the developing device 43 show a change in the equivalent inductances 631L, 632L according to the magnetic property of the carrier present in the developer 45. More specifically, the inductance 631L or 632L respectively increases when the developer 45 is present at the level 81 or 82. The switch 91 selects either the element 631 or 632. When the switch 95 is connected to a contact e in response to the selecting signal 95 from the CPU 61, the AC power source 101 supplies an AC voltage of a determined angular frequency $\omega$ to the element 631, and also to the amplifier 103 through the condenser 102. The output signal 105 from said amplifier 103 is supplied to the rectifying-smoothing circuit 107 composed for example of a diode and a condenser to a DC signal 109 of a voltage Vd, which is supplied to the comparator 113 together with the reference voltage Vr from the variable voltage source 111.

A resonance circuit is formed by the element 631 and the condenser 102. When the developer 45 is present at the lower detection level 81, the sensor element 631 shows an increased inductance 631L, causing a resonance with the angular frequency $\omega$ supplied from the AC power source 111. Such resonance does not occur, however, if the developer 45 is positioned below the detection level 81.

In case the switch 91 is shifted to the contact f, a similar resonance occurs or not respectively when the developer 45 is present at or below the detection level 82.

Such resonance significantly changes the DC voltage Vd, thus enabling detection of the presence of the developer 45 at the detection level 81 or 82 through comparison with a suitably selected reference voltage Vr. The volume detection signal 69 obtained from said comparator 113 is supplied to the toner hopper drive unit 121 in the CPU 61 to generate the drive signal 125 for the toner hopper 431. In this manner the toner concentration control explained in relation to FIGS. 15A and 15B can be achieved with a sensitivity improved by the afore-mentioned resonance, by selecting the detection level 81 or 82 respectively corresponding to the sensor 631 or 632 through the CPU 61.

FIG. 15B shows another example of the developing device 43, which is different from the structure of FIG. 15A in that a screw 131 is rotated at the volume detection of the developer 45 in order to accumulate said developer 45 against an inner wall of the container 71 where the sensor elements 631 and 632 are positioned, thereby enabling a more accurate volume detection.

Figure 17:
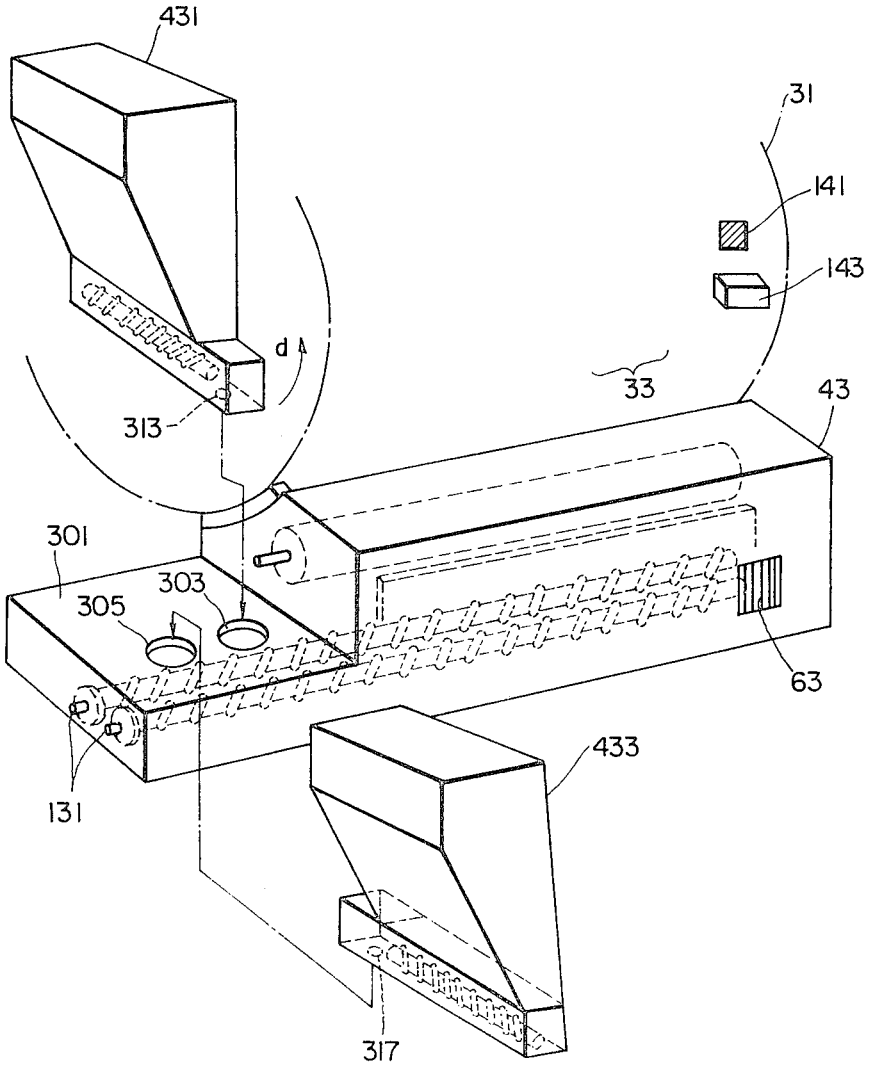
FIG. 17 is a perspective view showing the details of a part of the apparatus shown in FIG. 14.

FIG. 17 shows the details of a part of the structure shown in FIG. 14 wherein the reflective density detector unit 143 is positioned close to the photosensitive member 33 in order to optically measure the image density developed from an electrostatic latent image formed as will be explained later in the reference image area 141 on the photosensitive member 33. As already explained in the foregoing embodiments, said reflective density detector unit 143 emits a light beam 205 from the light-emitting diode 203 positioned in a casing 201 to the photosensitive member 33, and the reflected light 207 is received by the photodiode 209, as shown in FIG. 5.

The developing device 43 of the structure shown in FIG. 15B is provided, in the outer casing 301 thereof, with two apertures 303 and 305 communicating with the container 71. A toner hopper 431 and a carrier hopper 433 are mounted on said casing 301 in such a manner that a toner supply aperture 313 of said toner hopper 431 coincides with said aperture 303 and that a carrier supply aperture 317 of said carrier hopper 433 coincides with said aperture 305.

Figure 18:
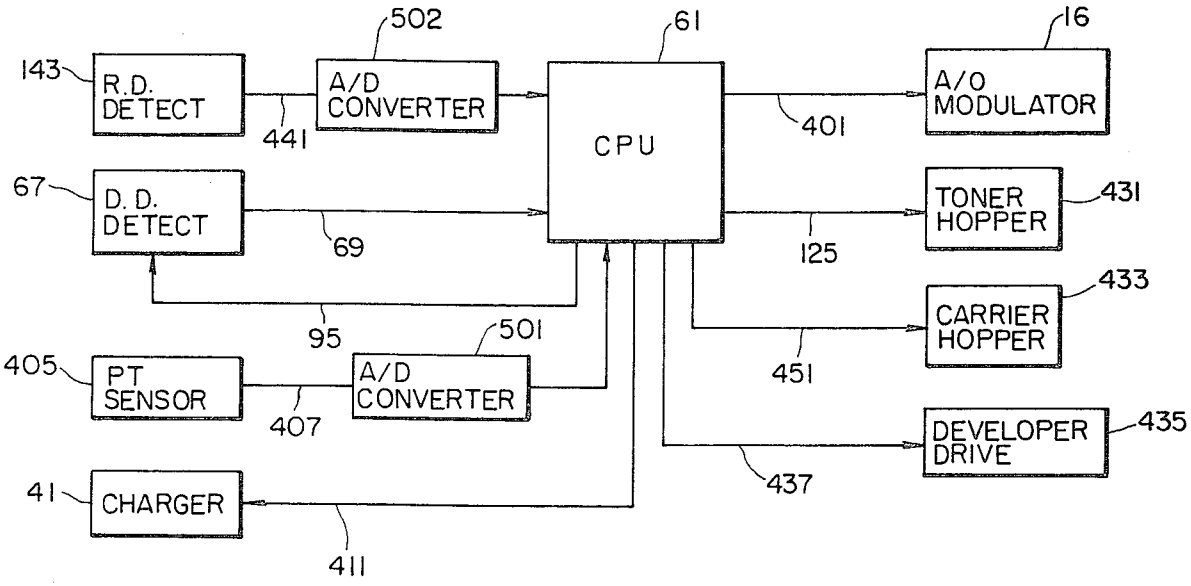
FIG. 18 is a block diagram of a control unit shown in FIG. 14.
Figure 19:
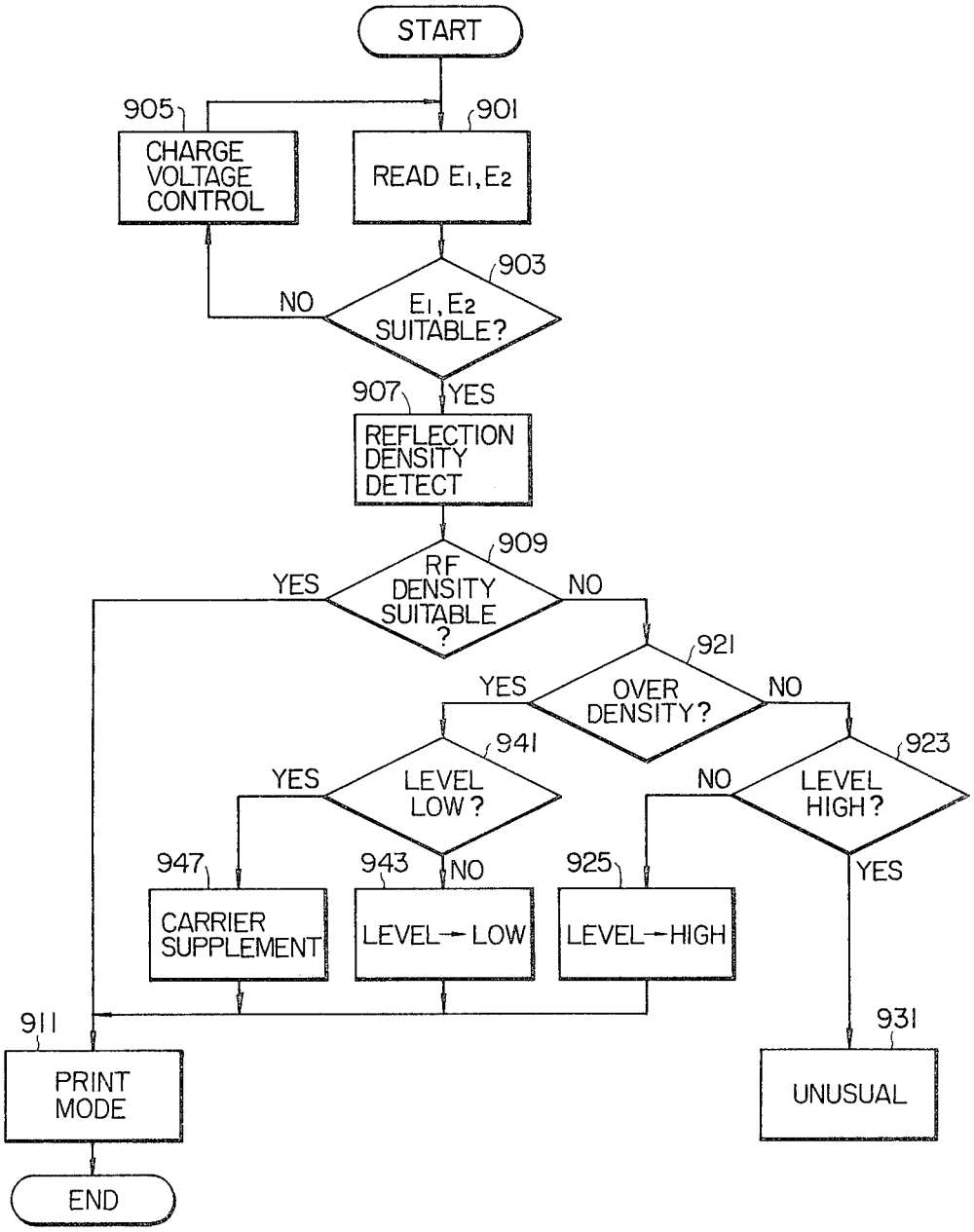
FIGS. 19 and 20 are flow charts showing the function of another embodiment of the present invention.

FIG. 18 shows the CPU 61 and the related control units, and FIG. 19 shows the related control sequence which will be explained in the following in relation to FIG. 18.

The Steps 901 to 907 are similar to the Steps 701 to 707 shown in FIG. 7 and are therefore omitted from the following explanation.

A Step 909 identifies whether the densities $D_p$ and $D_o$ satisfy a desired relationship, for example a determined density ratio or density difference. If the result of said identification is affirmative indicating an appropriate developer concentration, the program proceeds to the printing mode (Step 911).

On the other hand, if said result is negative indicating an inappropriate image density, the developer concentration is corrected in the following procedure, in which provided are two detection levels for the developer volume as already explained in relation to FIGS. 15A and 15B.

In this state the CPU 61 is capable of identifying whether the detection level is located at the level 81 or 82, from the logic state of the selecting signal 95 for the switch 91.

Subsequent to the above-mentioned Step 909, a Step 921 identifies whether the density of the developed image is abnormal. If the density is excessively low, the CPU 61 identifies the state of the detection level as explained above (Step 923) and shifts said detection level from the lower level 81 to the higher level 82 by shifting the switch 91 to the contact f in response to the selecting signal 95 (Step 925). Then the program proceeds to the printing mode (Step 911), in which the toner is supplied from the toner hopper 431 until the developer volume reaches the thus elevated level 82, whereby the toner concentration in the developer is elevated to an appropriate level capable of providing an appropriate image density.

On the otherhand, if the detection level is positioned at the higher level 82 in the Step 923, an abnormally signal is produced in the Step 931 since such situation is not normally expected.

Also if an excessively low reflective density is detected in the Step 921, a Step 941 identifies, from the state of the selecting signal 95, whether the switch 91 is connected to the contact e corresponding to the lower detection level. If the result of said identification is negative indicating that said switch 91 is connected to the contact f, the CPU 91 controls the selecting signal 95 to shift the switch 91 to the contact e, thus selecting the lower detection level 81 corresponding to the sensor element 631 (Step 943), and the program proceeds to the printing mode (Step 911). In this state the toner replenishment is suspended until the developer volume is reduced by consumption to said detection level 81, so that the toner concentration is gradually reduced during the use of the recording apparatus to maintain an appropriate image density.

On the other hand, if the Step 941 identifies that the detection level is already set at the lower level 81, the CPU 61 releases a carrier control signal 451 to supply a determined amount of carrier from the carrier hopper 433 (Step 947), thereby reducing the toner concentration with the resulting increase of developer volume, and the program proceeds to the printing mode in the Step 911.

During the printing operation in the Step 911, the developer volume in the developing device 43 is constantly measured, as already explained in the foregoing embodiment, according to a principle previously explained in relation to FIGS. 15A and 15B as disclosed in the aforementioned Japanese Laid-Open Pat. Nos. Sho 50-19459 and Sho 51-78343, and, upon detection of a decrease in the developer volume by the detector unit 67, the motor of the toner hopper 431 is energized, only when said developing device 43 is activated, to replenish the developing device 43 with a replenishing developer composed solely of toner or having a determined carrier ratio through the aperture 313 until said detector unit 67 no longer detects said decrease of developer.

As already explained in relation to the foregoing embodiment, such concentration controlling operation can be conducted either once every day immediately prior to the first printing operation after the start of power supply, or every time prior to the re-start of the printing operation after it is interrupted for a while, or a regular interval through the use of a timer.

Figure 20:
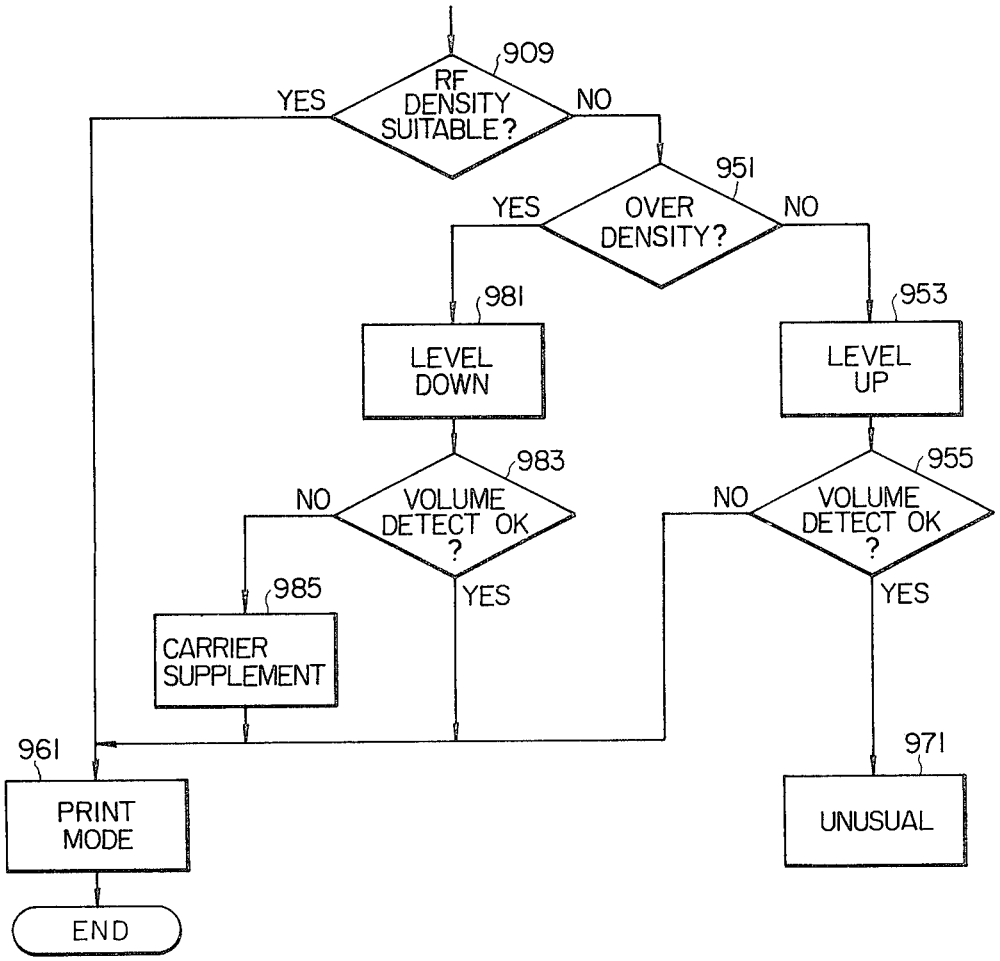

The CPU 61 does not store the state of the selecting signal 95 indicating the detection level in certain situations, for example after the start of power supply to the recording apparatus. FIG. 20 shows a control sequence for the concentration control in such situation. In the following description the sequence up to a Step 909 is omitted as it is same as that shown in FIG. 19.

If the Step 909 identifies that the reflective density of the developed image is not appropriate, said density is further identified in a Step 951. If the density is excessively low, the CPU 61 controls the selecting signal 95 to connect the switch 91 to the contact f, thereby selecting the element 632 corresponding to the higher detection level 82 (Step 953). In this state a Step 955 identifies if the developer volume reaches thus elevated detection level 82. If the result of said identification is negative, the program proceeds to the ordinary printing mode (Step 961). On the other hand, if said result is affirmative, indicating a developer volume exceeding the higher detection level 82 combined with an excessively low image density, an abnormality signal is generated since such situation is not anticipated (Step 971).

On the other hand, if the Step 951 identifies an excessively high image density, the CPU 61 controls the selecting signal 95 to connect the switch 91 to the contact e thereby selecting the lower detection level 81 corresponding to the sensor element 631 (Step 981). Then a Step 983 identifies whether the developer volume reaches the thus lowered detection level 81. If the result of said identification is affirmative, the program proceeds to the printing mode of the Step 961. On the other hand if said result is negative, indicating a developer volume less than the lower detection level 81 combined with an excessively high image density, the motor of the carrier hopper 433 is activated to replenish the developing device 43 with a determined amount of carrier through the carrier supply aperture 317, thereby reducing the toner concentration (Step 985), and the program proceeds to the printing mode in the Step 961.

During the printing mode in the Step 961, the developer volume detection explained in FIGS. 15A and 15B and the toner replenishment are effected in the same manner as explained in Step 911 in FIG. 19.

If the abnormality signal is generated in the Step 931 in FIG. 19 or in the Step 971 in FIG. 20, the CPU 61 selects a standard detection level for the developer volume detection, by so controlling the selecting signal 95 as to connect the switch 91 for example to the contact e, thus selecting the lower detection level 81 corresponding to the sensor element 631, and the printing mode is thereafter initiated in the Step 911 or 961, whereby the toner concentration control is continued under the thus selected standard detection level. Such procedure not only avoids the danger of significant change in the toner concentration in the developer eventually resulting from an erroneous detection in the detector unit 143 caused for example by a smear on the photodiode 209 in said detector unit 143, but also allows the continued use of the recording apparatus under said toner concentration control with such standard detection level, thereby eliminating the necessity for immediate repair of the detector unit 143.

Although the volume sensor 63 in the foregoing embodiment is composed of two elements 631 and 632 selectable by a switch, it is also possible to constitute said sensor by a single sensing element.

The number of detection levels for the developer volume explained in relation to FIGS. 15A and 15B is not necessarily limited to two but can be increased to three or more if necessary or desirable. For example the sensor 63 may be composed of three sensor elements selectable by the CPU 61. If the image density is excessively low, the CPU 61 stepwise elevates the detection level until it exceeds the present developer volume, and effects the toner replenishment up to said detection level. On the other hand if the image density is excessively high, the detection level is lowered by step and the toner replenishment is suspended until the developer volume reaches said detection level. The detection level is further lowered if the image density is still too high, and a determined amount of carrier is supplied if the image density is still too high at the lowest detection level. The amount of the carrier replenishment need not be accurately controlled by the use of several detection levels since the toner concentration in the developer can be re-adjusted by appropriate change of the detection level.

In the foregoing description, the reflective density detector unit 143 detects the density developed from a latent image formed in a reference image area 142 on the photosensitive member 33. It is nevertheless possible also to transfer said developed image onto a transfer sheet 49 and to measure the optical density of the thus recorded image by optical means similar to the detector unit 143. Furthermore it is possible to deposit toner on a separate probe composed of a transparent electrode or a metal electrode and to measure the transmission or reflective density of the thus deposited toner by similar optical means. In summary, the density of the developed image can be directly or indirectly measured by appropriate optical means.

The present invention is applicable not only to the laser beam printer but also to any recording apparatus in which an electrostatic latent image formed on a photosensitive member is developed with a developer containing toner and carrier. For example in a copier in which the latent image is formed by known slit exposure process, the latent image in the reference image area 141 can be obtained by scanning a reference density pattern positioned in a non-image area on the original platen.

As explained in detail in the foregoing, the present invention provides a developer concentration controlling device capable of providing a constant optimum image density by comparing the density of a reference image with a predetermined reference value and by regulating the detection level for the developer volume detection or replenishing the carrier in response to the result of said comparison. According to the present invention the developer concentration is so controlled as to provide an optimum image density through the direct measurement of the image density instead of the measurement of the toner concentration in the developer.

In addition the present invention allows avoidance of rapid change of the toner concentration in the developer caused by a failure in the image density detector unit or by an excessive replenishment of the carrier.

What we claim is:

1. A recording apparatus comprising:

plural process means for forming an image on a member;

first detector means for detecting the concentration of a developer for developing a latent image formed on said member;

second detector means for detecting the image density; and control means for controlling at least one of said process means in response to the output signals from said first and second detector means.

2. A recording apparatus according to claim 1, wherein said plural process means comprises a developing device, and said control means is adapted to control the concentration of the developer in said developing device in response to the output signals from said first and second detector means.

3. A recording apparatus according to claim 1, wherein said member is a photosensitive member.

4. A recording apparatus according to claim 3, wherein said second detector means is adapted to detect the density of a reference image formed and developed on said photosensitive member.

5. A recording apparatus according to claim 4, wherein said second detector means is adapted to detect the density of said reference image by optical means.

6. A recording apparatus according to claim 1 or 2, wherein said first detector means is adapted to detect the change in the magnetic permeability of the developer.

7. A recording apparatus according to claim 1 or 2, wherein said first detector means is adapted to detect the change in the dielectric constant of the developer.

8. A recording apparatus according to claim 1, wherein said control process is conducted during a prerotation phase of said recording apparatus prior to the image formation cycle therein.

9. A developer concentration controlling device comprising:

detector means for detecting the concentration of a developer for developing a latent image formed on a member, wherein said detector means has plural detection levels;

control means for selecting one of said detection levels in response to the developed image density; and replenishing means for replenishing the developer according to the detection level selected by said control means.

10. A developer concentration controlling device according to claim 9, wherein said control means is adapted to lower said detection level when said image density is high.

11. A developer concentration controlling device according to claim 9, wherein said control means is adapted to elevate said detection level when said image density is low.

12. A developer concentration controlling device according to claim 9, 10 or 11, which comprises effecting developer replenishment so as to maintain the volume of the developer at the volume detection level.

13. A developer concentration controlling device comprising:

detector means for detecting a decrease in the amount of carrier in a developer supply for developing a latent image, the developer being composed of toner and carrier, said detector means comprising a first detector for detecting the volume of the developer and a second detector for detecting the density of a developed image, wherein said detector means detects a decrease in the amount of carrier when outputs of said first and second detectors are at respective predetermined states; and replenishing means for effecting carrier replenishment to the developer supply in response to an output signal from said detector means.

14. A developer concentration controlling device according to claim 13, wherein said detector means is adapted to generate a signal indicating the decrease of the carrier when said second detector and said first detector respectively detect a developed image density higher than a predetermined value and a developer volume less than a predetermined value.

15. A recording apparatus comprising:

plural process means for forming an image on a member and developing the image with a developer including toner and carrier;

detector for detecting the density of an image developed by said process means; and control means for controlling replenishment of at least one of the toner and the carrier so as to control the concentration of the toner and carrier in the developer, said control means selecting one of a plurality of control values, including at least one standard value, for replenishment of one of the toner and carrier in accordance with the image density detected by said detector means, and when the image density is outside an acceptable range, said control means selecting a standard value of said plural control values for replenishment of said one of said toner and said carrier to control the concentration of the toner and carrier in the developer.

16. A recording apparatus according to claim 15, wherein said apparatus permits said plural process means to perform the image formation operation even when said detected image density is outside said acceptable range.

17. A recording apparatus according to claim 15 or 16, further comprising display means for indicating that said detected image density is outside said acceptable range.

* * * * *

UNITED STATES PATENT AND TRADEMARK OFFICE

CERTIFICATE OF CORRECTION

PATENT NO. : 4,468,112

DATED : August 28, 1984

INVENTOR(S) : AKIO SUZUKI, ET AL.

It is certified that error appears in the above-identified patent and that said Letters Patent is hereby corrected as shown below:

Column 1, line 30, "laryer" should read --layer--;
line 38, "eliminater" should read --eliminator--.

Column 6, line 4, "16" should read --61--;
line 5, "61" should read --16--.

Column 8, line 57, insert --are-- after "which"; delete "are" after "provided".

Column 9, line 46, delete the comma after "contact";
line 64, insert "ℓ" after "length".

Column 13, line 7, "abnormally" should read --abnormality--;
line 61, insert --the-- between "is" and "same".

Column 14, line 1, insert --the-- between "reaches" and "thus".

Column 15, line 8, "142" should read --141--.

Signed and Sealed this

Second Day of July 1985

[SEAL]

*Attest:*

DONALD J. QUIGG

*Attesting Officer*

*Acting Commissioner of Patents and Trademarks*